US006729845B2

(12) United States Patent
Rossi

(10) Patent No.: US 6,729,845 B2
(45) Date of Patent: May 4, 2004

(54) ROTOR BLADE FOR CENTRIFUGAL COMPRESSOR WITH A MEDIUM-HIGH FLOW COEFFICIENT

(75) Inventor: Eugenio Rossi, Viareggio (IT)

(73) Assignee: Nuovo Pigone Holding S.p.A., Florencé (IT)

( * ) Notice: Subject to any disclaimer, the term of this patent is extended or adjusted under 35 U.S.C. 154(b) by 18 days.

(21) Appl. No.: 10/290,259

(22) Filed: Nov. 8, 2002

(65) Prior Publication Data

US 2003/0091439 A1 May 15, 2003

(30) Foreign Application Priority Data

Nov. 15, 2001 (IT) ..... MI2001A2414

(51) Int. Cl.[7] ..... F01D 5/14
(52) U.S. Cl. ..... 416/223 R; 416/185
(58) Field of Search ..... 416/223 R, 185, 416/186 R, 187, 182, 183, 175, 223 B, 203, DIG. 2; 415/213 R

(56) References Cited

U.S. PATENT DOCUMENTS 4,666,373 A * 5/1987 Sugiura ..... 416/185
6,340,291 B1 * 1/2002 Reckert ..... 416/185

* cited by examiner

*Primary Examiner*—Edward K. Look
*Assistant Examiner*—J. M. McAleenan
(74) *Attorney, Agent, or Firm*—Nixon & Vanderhye

(57) ABSTRACT

A cylindrical blade for a rotor of the purely radial type of a centrifugal compressor with a medium-high flow coefficient comprises a first surface (3) of the pressure side and a second surface (5) of the suction side of equal curvature with generatrices parallel to the axis (Z) of rotation of the rotor, the lines of curvature of the said surfaces (3, 5) being defined, in a system of Cartesian coordinates (X, Y, Z) by the ratio between the coordinates of a discrete set of points (10) belonging to them and the outer radius (R) of the rotor (20).

5 Claims, 4 Drawing Sheets

X
2
1
7
9
20
22
21
4
O
Z
4
7
9
1
2

ROTOR BLADE FOR CENTRIFUGAL COMPRESSOR WITH A MEDIUM-HIGH FLOW COEFFICIENT

The present invention relates to a rotor blade for a centrifugal compressor with a medium-high flow coefficient.

More precisely, the invention relates to a cylindrical blade for a centrifugal rotor of a multi-stage compressor with a medium-high flow coefficient.

In the field of centrifugal compressors, the flow coefficient is defined as $\Phi=(4*q)/(\pi*d^2*u")$ in which:

q is the volume flow rate;

d is the outer diameter of the rotor;

u" is the peripheral velocity of the rotor.

This dimensionless coefficient can be used to define the operating characteristic of the compressor, and can be used to classify the different types of compressor at the design stage.

Compressors are therefore made to handle different flow rates, in other words to operate with different values of the flow coefficient, according to the applications for which they are intended.

Thus, for example, compressors with a medium flow coefficient are defined as those in which $\Phi$ has values in the vicinity of 0.04, and compressors with a medium-high flow coefficient are defined as those for which $\Phi$ is approximately 0.06.

However, one of the main requirements common to all compressors relates to the high aerodynamic efficiency which must be attained in most of the stages.

The geometric configuration of the rotor blading significantly affects the aerodynamic efficiency, due to the fact that the geometric characteristics of the blade determine the distribution of the relative velocities of the fluid along the rotor, thus affecting the distribution of the boundary layers along the walls and, in the final analysis, the friction losses.

The aerodynamic efficiency is particularly critical for rotors made with stages having two-dimensional blades, in other words purely radial rotors in which the blades are flat or cylindrical with generatrices parallel to the axis of rotation.

Conventionally, for reasons of economy in manufacture, the blades used in this type of rotor have a relatively simple geometry in which the median line of the section consists of an arc of a circumference and the thickness is constant along the blade, except in the region of the leading edge, which is formed by a semicircular fillet or, in particular cases, by a tapering of the thickness.

Although two-dimensional blades are made by relatively simple machining processes and are therefore very widely used, their geometry does not enable a high aerodynamic efficiency of the rotor to be achieved.

A first object of the present invention is therefore to provide a blade which, by means of a suitable configuration, enables a high aerodynamic efficiency to be achieved.

Another object of the present invention is to provide a blade which can be manufactured economically on a large scale by automated processes.

These and other objects of the present invention are achieved with the rotor blade for a centrifugal compressor with a medium-high flow coefficient according to the content of claim 1.

Further characteristics and advantages of the present invention are described in the subsequent claims.

The characteristics and advantages of the rotor blade for a centrifugal compressor according to the present invention will be made clearer by the following description, which is provided by way of example and without restrictive intent, and which refers to the attached drawings, in which.

Figure 1:
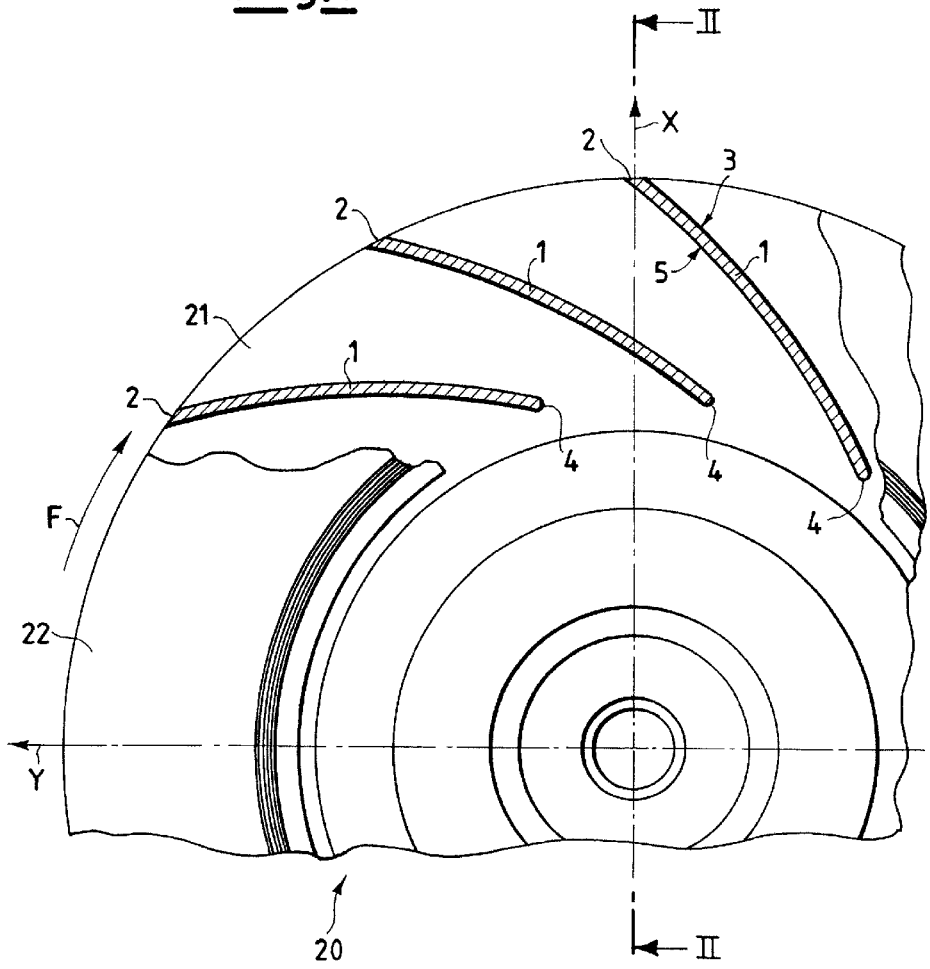
FIG. 1 is a front view, in partial section, of a rotor having blades according to the invention.
Figure 2:
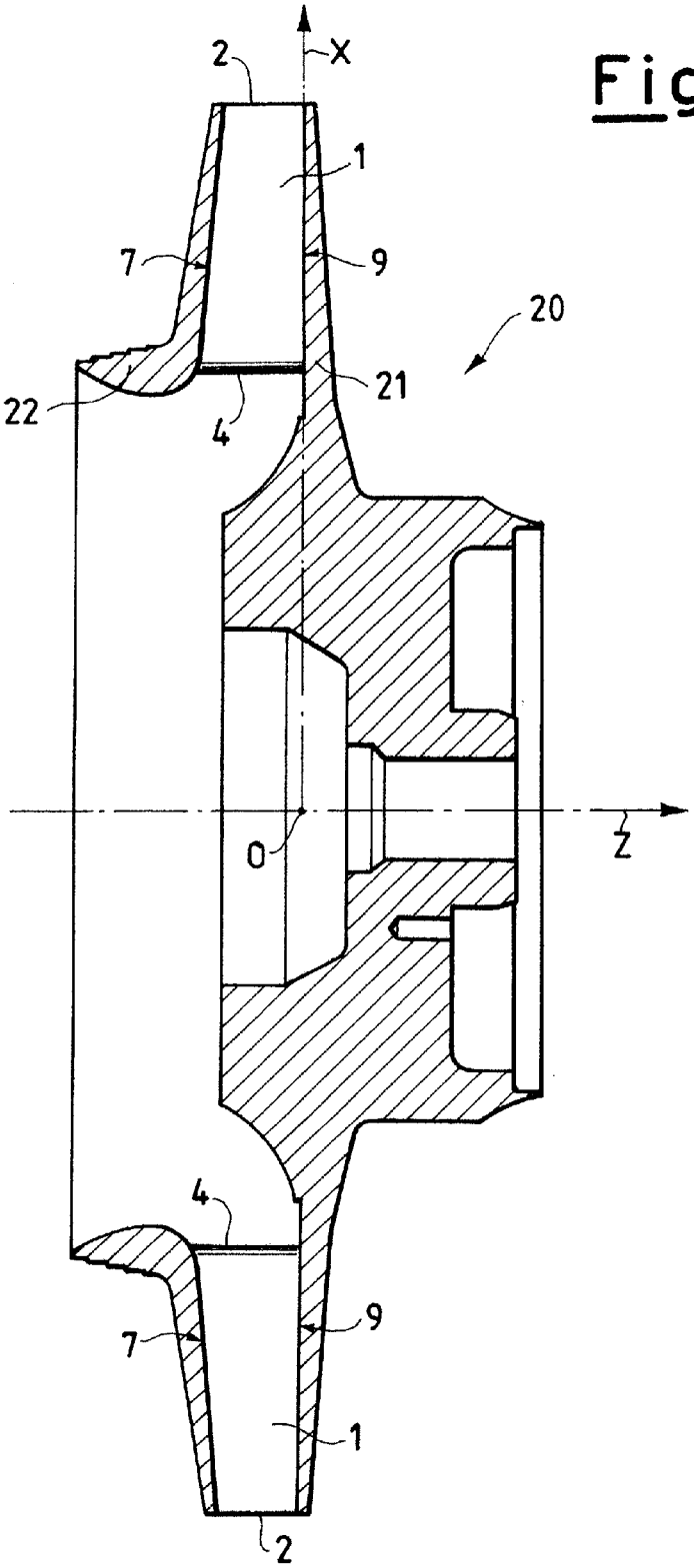
FIG. 2 is a view, in partial section, of the rotor, taken through the line II—II in FIG. 1.

With reference to FIGS. 1 and 2, a rotor 20 of the purely radial type with an outer radius R belonging to a centrifugal compressor with a medium-high flow coefficient comprises a plurality of cylindrical blades 1 positioned between a disc 21 and a counter-disc 22.

The blades 1 are made, by an established technique, in one piece with the said disc 21 and/or counter-disc 22, or are applied to the disc 21.

Each blade 1 comprises a first surface 3 of the pressure side facing forwards with respect to the direction of rotation of the rotor, indicated by the arrow F in FIG. 1, and a second surface 5 of the suction side, opposite the first surface.

The surfaces 3 and 5 are cylindrical, and are made essentially with equal curvature and with generatrices parallel to the axis Z of rotation of the rotor 20.

The two surfaces 3 and 5 are joined together at one end by a leading edge 4, located at the suction inlet of the rotor, formed by a tapering of the thickness of the blade 1.

At the outlet end of the rotor, the aforesaid surfaces 3 and 5 terminate in a transverse edge 2, flush with the outer circumference of the disc 21 and the counter-disc 22.

Figure 3:
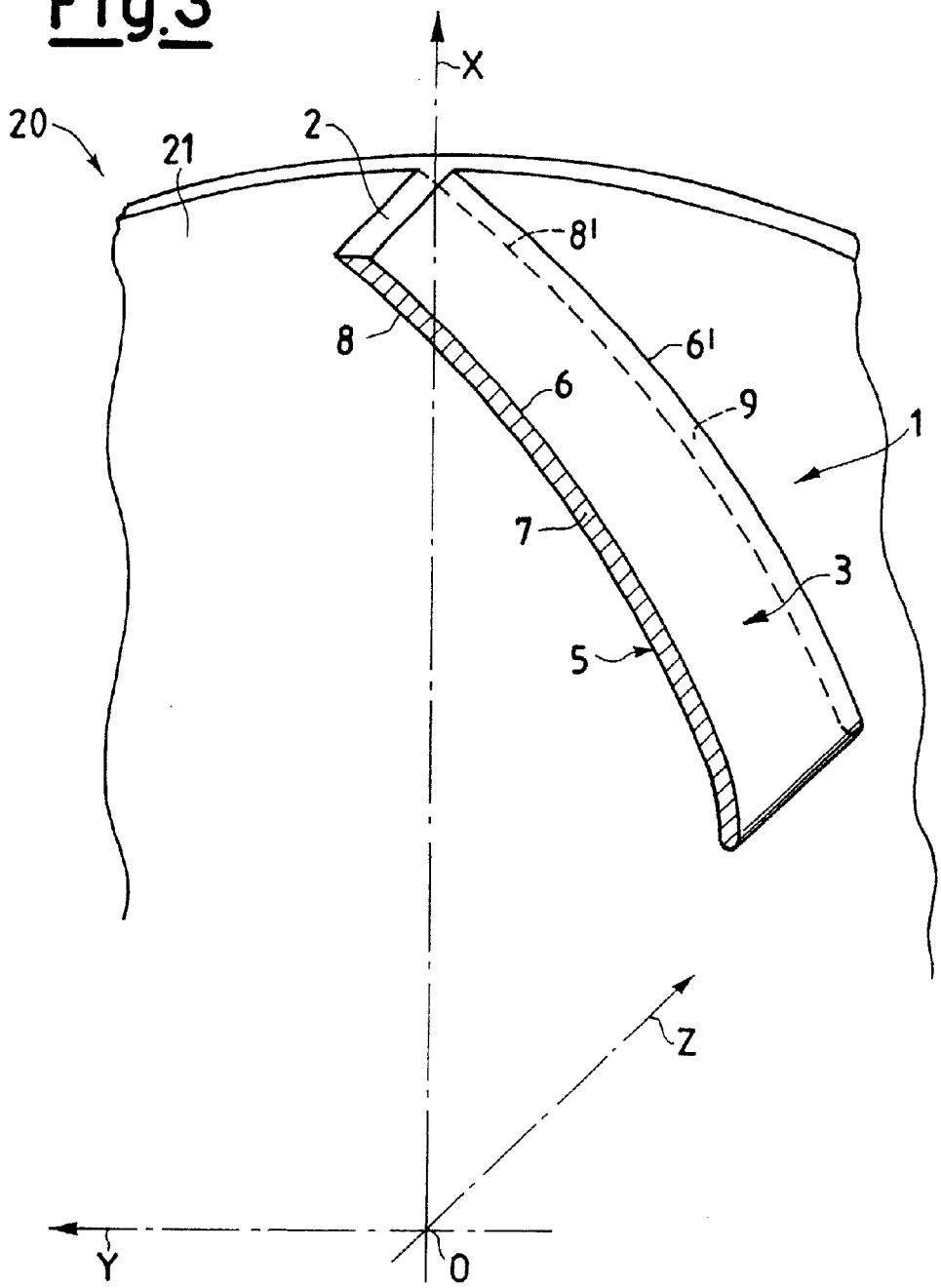
FIG. 3 is a schematic axonometric view of a blade according to the invention.
Figure 4:
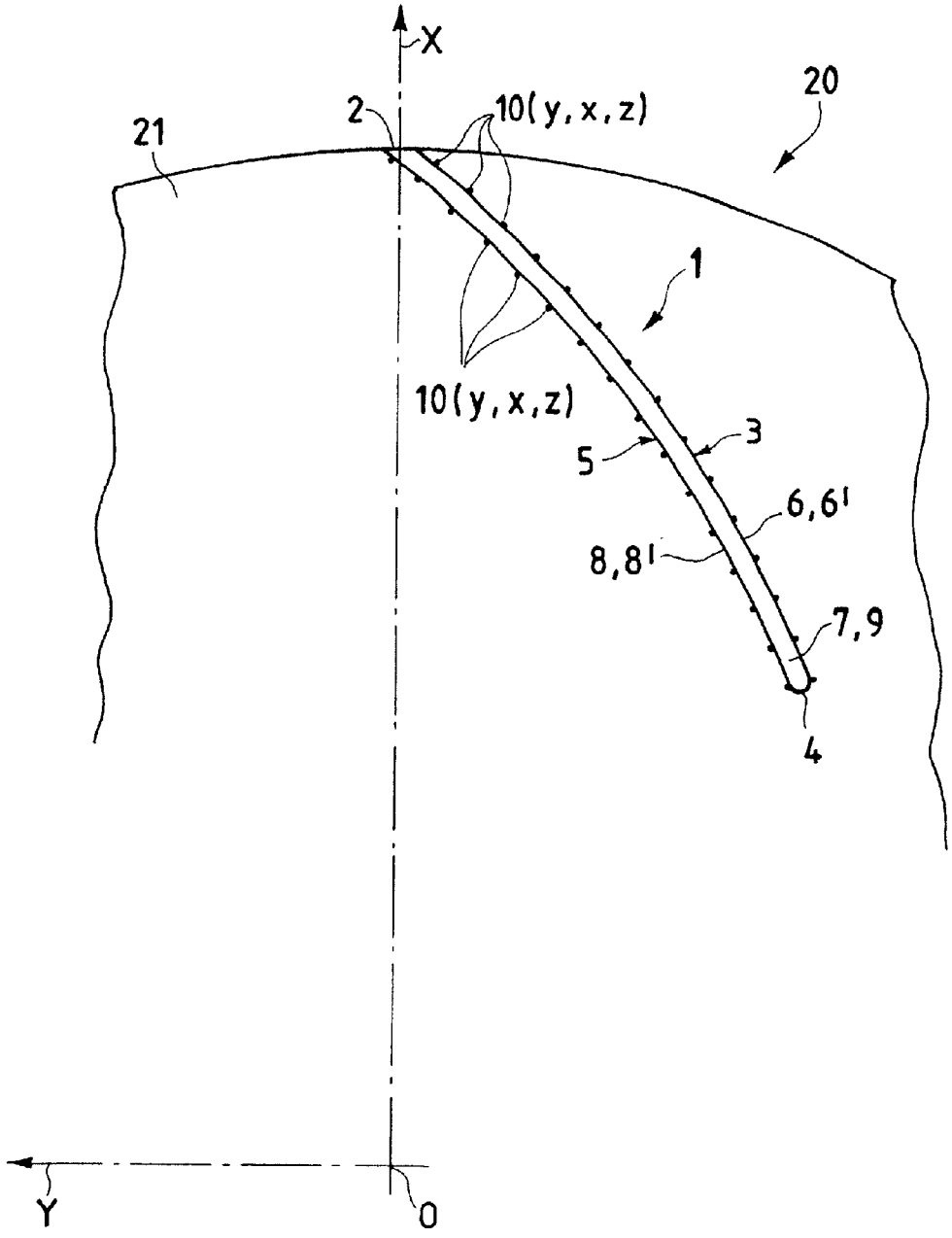
FIG. 4 shows the profile of the blade of FIG. 3.

As shown more clearly in FIGS. 3 and 4, the blade 1 has, at its junction with the disc 21, a first section 9 which is flat and lies on a plane Y,X of a right-handed Cartesian system having an axis of abscissae Y, an axis of ordinates X and an axis Z coinciding with the axis of rotation of the rotor and orientated towards the inside of the machine.

The origin O of this reference system lies at the intersection of the plane Y, X, on which the joining section 9 lies, with the axis of rotation of the rotor.

The blade 1 is joined to the counter-disc 22 in a second section 7 which is curved, according to the known art, in the proximity of the leading edge 4 in such a way as to follow the curvature of the counter-disc 22 at the inlet of the rotor.

Since, as stated previously, the blade 1 is of the cylindrical type, the projections on the plane Y, X of the sections 7 and 9 are essentially coincident.

The profile of the blade 1, and consequently its curvature, are therefore identified by the intersection of the said surfaces 3 and 5 with the plane Y, X.

For a full definition of the curvature of the blade 1, however, it is necessary to refer also to the curvature of the section 7 in the proximity of the leading edge 4 of the blade and in the direction of the inlet of the rotor.

Therefore, when this section 7 has been identified in the three-dimensional space by means of the aforesaid Cartesian reference system Y, X, Z, the blade 1 is defined.

In particular, the intersection of the surfaces 3 and 5 with the section 7 forms two curved lines, namely a first edge line 6 on the pressure side and a second edge line 8 on the suction side, determined by a discrete set of points 10 belonging to them, whose coordinates x, y, z with respect to the three axes Y, X, Z are conveniently expressed as a function of the outer radius R of the rotor 20.

In a corresponding way, the intersection of the surfaces 3 and 5 with the section 9 forms two curved lines, namely a third edge line 6' on the pressure side and a fourth edge line 8' on the suction side.

Since the blade 1 is cylindrical, and since the Cartesian reference system Y, X, Z has been adopted, the edge lines 6' and 8' are defined by the same x and y coordinates as those of the corresponding lines 6 and 8, while they have a z coordinate of zero for all the points lying on them.

The surfaces 3 and 5, and essentially the blade 1, can be conveniently formed by means of automatic machines, for example those of the numerically controlled type, or the like.

According to the operating conditions for which they are intended, the rotor 20 and correspondingly the blades 1 can also be made in various sizes.

According to the known law of similarity, the characteristics of a rotor are, within certain limits, essentially dependent on the curvature of the blades, and are therefore, as a first approximation, equal for similar rotors.

By applying the law of similarity, it is possible to disregard the absolute dimensions of the blade and define its geometry, for example by means of the ratios x/R, y/R and z/R of the coordinates of the points 10 to the value of the outer radius R of the rotor.

It has also been found that the efficiency varies only slightly with the variation of the curvatures of the surfaces 3 and 5, and therefore of the lines 6, 6', 8, 8', when these are kept within a range of variation of the coordinates y, x, z of the points 10 equal to ±0.600 mm.

The lines 6 and 8 of the blade 1 according to the invention, expressed in each case as a function of the outer radius R of the rotor, in the form of the ratios y/R, x/R and z/R between the values of the coordinates of each point 10 and the value of the said radius R, are defined by the following values, for the line 6:

x/R=0.513; y/R=−0.348; z/R=−0.153;
x/R=0.527; y/R=−0.347; z/R=−0.152;
x/R=0.539; y/R=−0.343; z/R=−0.151;
x/R=0.551; y/R=−0.338; z/R=−0.150;
x/R=0.563; y/R=−0.332; z/R=−0.149;
x/R=0.574; y/R=−0.327; z/R=−0.149;
x/R=0.585; y/R=−0.321; z/R=−0.148;
x/R=0.597; y/R=−0.314; z/R=−0.147;
x/R=0.608; y/R=−0.308; z/R=−0.147;
x/R=0.619; y/R=−0.301; z/R=−0.146;
x/R=0.630; y/R=−0.294; z/R=−0.145;
x/R=0.640; y/R=−0.287; z/R=−0.144;
x/R=0.651; y/R=−0.281; z/R=−0.144;
x/R=0.662; y/R=−0.274; z/R=−0.143;
x/R=0.673; y/R=−0.267; z/R=−0.142;
x/R=0.684; y/R=−0.259; z/R=−0.141;
x/R=0.694; y/R=−0.252; z/R=−0.140;
x/R=0.705; y/R=−0.245; z/R=−0.140;
x/R=0.715; y/R=−0.238; z/R=−0.139;
x/R=0.726; y/R=−0.230; z/R=−0.138;
x/R=0.736; y/R=−0.223; z/R=−0.137;
x/R=0.747; y/R=−0.215; z/R=−0.136;
x/R=0.757; y/R=−0.208; z/R=−0.135;
x/R=0.767; y/R=−0.200; z/R=−0.135;
x/R=0.778; y/R=−0.192; z/R=−0.134;
x/R=0.788; y/R=−0.185; z/R=−0.133;
x/R=0.798; y/R=−0.177; z/R=−0.132;
x/R=0.808; y/R=−0.169; z/R=−0.131;
x/R=0.818; y/R=−0.161; z/R=−0.130;
x/R=0.828; y/R=−0.153; z/R=−0.129;
x/R=0.839; y/R=−0.146; z/R=−0.128;
x/R=0.849; y/R=−0.138; z/R=−0.127;
x/R=0.859; y/R=−0.130; z/R=−0.127;
x/R=0.869; y/R=−0.122; z/R=−0.126;
x/R=0.878; y/R=−0.114; z/R=−0.125;
x/R=0.888; y/R=−0.105; z/R=−0.124;
x/R=0.898; y/R=−0.097; z/R=−0.123;
x/R=0.908; y/R=−0.089; z/R=−0.122;
x/R=0.918; y/R=−0.081; z/R=−0.121;
x/R=0.928; y/R=−0.073; z/R=−0.120;
x/R=0.938; y/R=−0.065; z/R=−0.119;
x/R=0.948; y/R=−0.057; z/R=−0.118;
x/R=0.957; y/R=−0.049; z/R=−0.117;
x/R=0.967; y/R=−0.040; z/R=−0.116;
x/R=0.977; y/R=−0.032; z/R=−0.115;
x/R=0.987; y/R=−0.024; z/R=−0.114;
x/R=0.997; y/R=−0.016; z/R=−0.113;
x/R=1.006; y/R=−0.008; z/R=−0.113;

and for line 8:

x/R=0.513; y/R=−0.348; z/R=−0.153;
x/R=0.522; y/R=−0.338; z/R=−0.153;
x/R=0.532; y/R=−0.330; z/R=−0.152;
x/R=0.543; y/R=−0.323; z/R=−0.152;
x/R=0.554; y/R=−0.316; z/R=−0.151;
x/R=0.565; y/R=−0.310; z/R=−0.150;
x/R=0.575; y/R=−0.303; z/R=−0.150;
x/R=0.586; y/R=−0.297; z/R=−0.149;
x/R=0.597; y/R=−0.290; z/R=−0.148;
x/R=0.608; y/R=−0.284; z/R=−0.148;
x/R=0.619; y/R=−0.277; z/R=−0.147;
x/R=0.630; y/R=−0.271; z/R=−0.146;
x/R=0.641; y/R=−0.264; z/R=−0.145;
x/R=0.651; y/R=−0.257; z/R=−0.144;
x/R=0.662; y/R=−0.250; z/R=−0.144;
x/R=0.672; y/R=−0.243; z/R=−0.143;
x/R=0.683; y/R=−0.236; z/R=−0.142;
x/R=0.693; y/R=−0.228; z/R=−0.141;
x/R=0.704; y/R=−0.221; z/R=−0.140;
x/R=0.714; y/R=−0.214; z/R=−0.140;
x/R=0.725; y/R=−0.207; z/R=−0.139;
x/R=0.735; y/R=−0.199; z/R=−0.138;
x/R=0.745; y/R=−0.192; z/R=−0.137;
x/R=0.755; y/R=−0.184; z/R=−0.136;
x/R=0.766; y/R=−0.176; z/R=−0.135;
x/R=0.776; y/R=−0.169; z/R=−0.135;
x/R=0.786; y/R=−0.161; z/R=−0.134;
x/R=0.796; y/R=−0.153; z/R=−0.133;
x/R=0.806; y/R=−0.146; z/R=−0.132;
x/R=0.816; y/R=−0.138; z/R=−0.131;
x/R=0.826; y/R=−0.130; z/R=−0.130;
x/R=0.836; y/R=−0.122; z/R=−0.129;
x/R=0.846; y/R=−0.114; z/R=−0.128;
x/R=0.856; y/R=−0.106; z/R=−0.127;
x/R=0.866; y/R=−0.098; z/R=−0.121;
x/R=0.876; y/R=−0.090; z/R=−0.125;
x/R=0.886; y/R=−0.082; z/R=−0.124;
x/R=0.896; y/R=−0.074; z/R=−0.123;

x/R=0.905; y/R=−0.066; z/R=−0.122;
x/R=0.915; y/R=−0.058; z/R=−0.121;
x/R=0.925; y/R=−0.050; z/R=−0.120;
x/R=0.935; y/R=−0.041; z/R=−0.119;
x/R=0.945; y/R=−0.033; z/R=−0.118;
x/R=0.954; y/R=−0.025; z/R=−0.117;
x/R=0.964; y/R=−0.017; z/R=−0.116;
x/R=0.974; y/R=−0.009; z/R=−0.115;
x/R=0.984; y/R=−0.001; z/R=−0.114;
x/R=0.994; y/R=0.008; z/R=−0.113.

Example of Embodiment

A rotor 20 for a compressor with a medium-high flow coefficient was made with an outer radius of 200 mm and with 19 cylindrical blades 1 whose surfaces 3 on the pressure sides and surfaces 5 on the suction sides have equal curvature.

These surfaces 3 and 5 are defined, in a right-hand system of Cartesian axes Y, X, Z having an axis of abscissae Y, an axis of ordinates X and an axis Z coinciding with the axis of rotation of the rotor and orientated towards the inside of the machine, by the following coordinates x, y, z of a discrete set of points 10 belonging to the edge lines 6 and 8 generated respectively by the surfaces 3 and 5 at the intersection with the section 7 of the blade 1 in contact with the counter-disc 22 of the rotor.

The line 6 is defined by points 10 having the following coordinates:

x=102.583; y=−69.663; z=−30.610
x=105.308; y=−69.373; z=−30.332
x=107.762; y=−68.532; z=−30.203
x=110.161; y=−67.565; z=−30.052
x=112.510; y=−66.499; z=−29.897
x=114.814; y=−65.348; z=−29.748
x=117.074; y=−64.114; z=−29.602
x=119.304; y=−62.830; z=−29.455
x=121.519; y=−61.522; z=−29.308
x=123.723; y=−60.195; z=−29.159
x=125.915; y=−58.850; z=−29.008
x=128.096; y=−57.489; z=−28.857
x=130.266; y=−56.111; z=−28.707
x=132.426; y=−54.717; z=−28.555
x=134.576; y=−53.308; z=−28.400
x=136.714; y=−51.882; z=−28.241
x=138.841; y=−50.443; z=−28.080
x=140.958; y=−48.989; z=−27.918
x=143.066; y=−47.522; z=−27.754
x=145.163; y=−46.043; z=−27.589
x=147.252; y=−44.552; z=−27.426
x=149.332; y=−43.050; z=−27.262
x=151.403; y=−41.537; z=−27.094
x=153.466; y=−40.014; z=−26.921
x=155.521; y=−38.480; z=−26.747
x=157.568; y=−36.938; z=−26.572
x=159.608; y=−35.387; z=−26.395
x=161.641; y=−33.827; z=−26.217
x=163.667; y=−32.259; z=−26.037
x=165.686; y=−30.685; z=−25.857
x=167.700; y=−29.103; z=−25.678
x=169.708; y=−27.514; z=−25.498
x=171.710; y=−25.918; z=−25.313
x=173.707; y=−24.317; z=−25.125
x=175.698; y=−22.710; z=−24.935
x=177.685; y=−21.098; z=−24.744
x=179.667; y=−19.482; z=−24.554
x=181.645; y=−17.862; z=−24.366
x=183.620; y=−16.240; z=−24.174
x=185.592; y=−14.614; z=−23.978
x=187.561; y=−12.987; z=−23.779
x=189.528; y=−11.358; z=−23.579
x=191.494; y=−9.727; z=−23.378
x=193.458; y=−8.094; z=−23.179
x=195.421; y=−6.457; z=−22.979
x=197.381; y=−4.817; z=−22.739
x=199.333; y=−3.173; z=−22.533
x=201.286; y=−1.532; z=−22.552.

The line 8 is defined by points 10 having the following coordinates:

x=102.582; y=−69.661; z=−30.610
x=104.393; y=−67.609; z=−30.544
x=106.475; y=−66.003; z=−30.405
x=108.594; y=−64.650; z=−30.312
x=110.739; y=−63.275; z=−30.229
x=112.904; y=−61.945; z=−30.098
x=115.091; y=−60.656; z=−29.960
x=117.285; y=−59.378; z=−29.817
x=119.470; y=−58.086; z=−29.670
x=121.646; y=−56.776; z=−29.519
x=123.810; y=−55.449; z=−29.367
x=125.965; y=−54.104; z=−29.212
x=128.110; y=−52.742; z=−29.056
x=130.245; y=−51.364; z=−28.899
x=132.369; y=−49.971; z=−28.744
x=134.484; y=−48.562; z=−28.587
x=136.588; y=−47.138; z=−28.427
x=138.684; y=−45.699; z=−28.264
x=140.770; y=−44.247; z=−28.097
x=142.848; y=−42.781; z=−27.930
x=144.919; y=−41.303; z=−27.760
x=146.981; y=−39.834; z=−27.591
x=149.039; y=−38.313; z=−27.422
x=151.082; y=−36.802; z=−27.253
x=153.121; y=−35.280; z=−27.079
x=155.154; y=−33.749; z=−26.901
x=157.180; y=−32.208; z=−26.722
x=159.199; y=−30.658; z=−26.542
x=161.213; y=−29.101; z=−26.359
x=163.221; y=−27.535; z=−26.175
x=165.223; y=−25.962; z=−25.990
x=167.221; y=−24.381; z=−25.806
x=169.213; y=−22.794; z=−25.622
x=171.200; y=−21.200; z=−25.436
x=173.182; y=−19.601; z=−24.245
x=175.161; y=−17.995; z=−25.051
x=177.135; y=−16.385; z=−24.856
x=179.108; y=−14.770; z=−24.660
x=181.078; y=−13.151; z=−24.466 x=183.046; y=−11.529; z=−24.272
x=185.012; y=−9.905; z=−24.074
x=186.976; y=−8.278; z=−23.871
x=188.938; y=−6.650; z=−23.666
x=190.899; y=−5.020; z=−23.461
x=192.857; y=−3.387; z=−23.256
x=194.810; y=−1.752; z=−23.056
x=196.754; y=−0.115; z=−22.835
x=198.714; y=1.532; z=−22.581.

When the rotor 20 was subjected to fluid-dynamic testing, its polytropic stage efficiency was found to be considerably higher than that of prior art rotors.

What is claimed is:

1. Cylindrical blade for a rotor of the purely radial type of a centrifugal compressor with a medium-high flow coefficient, the blade (1) being positioned between a disc (21) and a counter-disc (22) forming the rotor, and comprising a first surface (3) of the pressure side and a second surface (5) of the suction side having equal curvature, both having generatrices parallel to the axis (Z) of rotation of the rotor, the lines of curvature of the said surfaces (3, 5) being defined, in the direction of the axis (Z), by a first section (7) of the blade in contact with the counter-disc (22), and by a second section (9) of the blade (1) in contact with the disc (21), characterized in that, in a right-hand Cartesian reference system (Y, X, Z) having an axis of ordinates (X) and an axis of abscissae (Y), with the plane (YX) coinciding with the said second contact section (9), and with the axis (Z) coinciding with the axis of rotation of the rotor and orientated towards the interior of the machine, the intersection of each of the said surfaces (3, 5) with the section (7) defines two curved lines, namely a first edge line (6) of the pressure side and a second edge line (8) of the suction side, determined by a discrete set of points (10) belonging to the lines (6, 8) whose coordinates (y, x, z) with respect to the three axes (Y, X, Z) are expressed as a function of the outer radius (R) of the rotor (20) as the ratios y/R,
x/R and z/R, the coordinates (y, x, z) of the said points being variable within a range of ±0.600 mm, the line (6) being defined by the following ratios:

x/R=0.513; y/R=−0.348; z/R=−0.153;
x/R=0.527; y/R=−0.347; z/R=−0.152;
x/R=0.539; y/R=−0.343; z/R=−0.151;
x/R=0.551; y/R=−0.338; z/R=−0.150;
x/R=0.563; y/R=−0.332; z/R=−0.149;
x/R=0.574; y/R=−0.327; z/R=−0.149;
x/R=0.585; y/R=−0.321; z/R=−0.148;
x/R=0.597; y/R=−0.314; z/R=−0.147;
x/R=0.608; y/R=−0.308; z/R=−0.147;
x/R=0.619; y/R=−0.301; z/R=−0.146;
x/R=0.630; y/R=−0.294; z/R=−0.145;
x/R=0.640; y/R=−0.287; z/R=−0.144;
x/R=0.651; y/R=−0.281; z/R=−0.144;
x/R=0.662; y/R=−0.274; z/R=−0.143;
x/R=0.673; y/R=−0.267; z/R=−0.142;
x/R=0.684; y/R=−0.259; z/R=−0.141;
x/R=0.694; y/R=−0.252; z/R=−0.140;
x/R=0.705; y/R=−0.245; z/R=−0.140;
x/R=0.715; y/R=−0.238; z/R=−0.139;
x/R=0.726; y/R=−0.230; z/R=−0.138;
x/R=0.736; y/R=−0.223; z/R=−0.137;
x/R=0.747; y/R=−0.215; z/R=−0.136;
x/R=0.757; y/R=−0.208; z/R=−0.135;
x/R=0.767; y/R=−0.200; z/R=−0.135;
x/R=0.778; y/R=−0.192; z/R=−0.134;
x/R=0.788; y/R=−0.185; z/R=−0.133;
x/R=0.798; y/R=−0.177; z/R=−0.132;
x/R=0.808; y/R=−0.169; z/R=−0.131;
x/R=0.818; y/R=−0.161; z/R=−0.130;
x/R=0.828; y/R=−0.153; z/R=−0.129;
x/R=0.839; y/R=−0.146; z/R=−0.128;
x/R=0.849; y/R=−0.138; z/R=−0.127;
x/R=0.859; y/R=−0.130; z/R=−0.127;
x/R=0.869; y/R=−0.122; z/R=−0.126;
x/R=0.878; y/R=−0.114; z/R=−0.125;
x/R=0.888; y/R=−0.105; z/R=−0.124;
x/R=0.898; y/R=−0.097; z/R=−0.123;
x/R=0.908; y/R=−0.089; z/R=−0.122;
x/R=0.918; y/R=−0.081; z/R=−0.121;
x/R=0.928; y/R=−0.073; z/R=−0.120;
x/R=0.938; y/R=−0.065; z/R=−0.119;
x/R=0.948; y/R=−0.057; z/R=−0.118;
x/R=0.957; y/R=−0.049; z/R=−0.117;
x/R=0.967; y/R=−0.040; z/R=−0.116;
x/R=0.977; y/R=−0.032; z/R=−0.115;
x/R=0.987; y/R=−0.024; z/R=−0.114;
x/R=0.997; y/R=−0.016; z/R=−0.113;
x/R=1.006; y/R=−0.008; z/R=−0.113;

the line (8) being defined by the following ratios:

x/R=0.513; y/R=−0.348; z/R=−0.153;
x/R=0.522; y/R=−0.338; z/R=−0.153;
x/R=0.532; y/R=−0.330; z/R=−0.152;
x/R=0.543; y/R=−0.323; z/R=−0.152;
x/R=0.554; y/R=−0.316; z/R=−0.151;
x/R=0.565; y/R=−0.310; z/R=−0.150;
x/R=0.575; y/R=−0.303; z/R=−0.150;
x/R=0.586; y/R=−0.297; z/R=−0.149;
x/R=0.597; y/R=−0.290; z/R=−0.148;
x/R=0.608; y/R=−0.284; z/R=−0.148;
x/R=0.619; y/R=−0.277; z/R=−0.147;
x/R=0.630; y/R=−0.271; z/R=−0.146;
x/R=0.641; y/R=−0.264; z/R=−0.145;
x/R=0.651; y/R=−0.257; z/R=−0.144;
x/R=0.662; y/R=−0.250; z/R=−0.144;
x/R=0.672; y/R=−0.243; z/R=−0.143;
x/R=0.683; y/R=−0.236; z/R=−0.142;
x/R=0.693; y/R=−0.228; z/R=−0.141;
x/R=0.704; y/R=−0.221; z/R=−0.140;
x/R=0.714; y/R=−0.214; z/R=−0.140;
x/R=0.725; y/R=−0.207; z/R=−0.139;
x/R=0.735; y/R=−0.199; z/R=−0.138;
x/R=0.745; y/R=−0.192; z/R=−0.137;
x/R=0.755; y/R=−0.184; z/R=−0.136;
x/R=0.766; y/R=−0.176; z/R=−0.135;
x/R=0.776; y/R=−0.169; z/R=−0.135;
x/R=0.786; y/R=−0.161; z/R=−0.134;
x/R=0.796; y/R=−0.153; z/R=−0.133;
x/R=0.806; y/R=−0.146; z/R=−0.132;
x/R=0.816; y/R=−0.138; z/R=−0.131;

x/R=0.826; y/R=−0.130; z/R=−0.130;
x/R=0.836; y/R=−0.122; z/R=−0.129;
x/R=0.846; y/R=−0.114; z/R=−0.128;
x/R=0.856; y/R=−0.106; z/R=−0.127;
x/R=0.866; y/R=−0.098; z/R=−0.121;
x/R=0.876; y/R=−0.090; z/R=−0.125;
x/R=0.886; y/R=−0.082; z/R=−0.124;
x/R=0.896; y/R=−0.074; z/R=−0.123;
x/R=0.905; y/R=−0.066; z/R=−0.122;
x/R=0.915; y/R=−0.058; z/R=−0.121;
x/R=0.925; y/R=−0.050; z/R=−0.120;
x/R=0.935; y/R=−0.041; z/R=−0.119;
x/R=0.945; y/R=−0.033; z/R=−0.118;
x/R=0.954; y/R=−0.025; z/R=−0.117;
x/R=0.964; y/R=−0.017; z/R=−0.116;
x/R=0.974; y/R=−0.009; z/R=−0.115;
x/R=0.984; y/R=−0.001; z/R=−0.114;
x/R=0.994; y/R=0.008; z/R=−0.113.

2. Cylindrical blade according to claim 1, in which the said lines (6, 8) are defined by the following coordinates (y, x, z) of a discrete set of points (10) belonging to the said lines (6, 8) and in which the said rotor (20) has an outer radius (R) of 200 mm, the line (6) being defined by points (10) having the following coordinates:

x=102.583; y=−69.663; z=−30.610
x=105.308; y=−69.373; z=−30.332
x=107.762; y=−68.532; z=−30.203
x=110.161; y=−67.565; z=−30.052
x=112.510; y=−66.499; z=−29.897
x=114.814; y=−65.348; z=−29.748
x=117.074; y=−64.114; z=−29.602
x=119.304; y=−62.830; z=−29.455
x=121.519; y=−61.522; z=−29.308
x=123.723; y=−60.195; z=−29.159
x=125.915; y=−58.850; z=−29.008
x=128.096; y=−57.489; z=−28.857
x=130.266; y=−56.111; z=−28.707
x=132.426; y=−54.717; z=−28.555
x=134.576; y=−53.308; z=−28.400
x=136.714; y=−51.882; z=−28.241
x=138.841; y=−50.443; z=−28.080
x=140.958; y=−48.989; z=−27.918
x=143.066; y=−47.522; z=−27.754
x=145.163; y=−46.043; z=−27.589
x=147.252; y=−44.552; z=−27.426
x=149.332; y=−43.050; z=−27.262
x=151.403; y=−41.537; z=−27.094
x=153.466; y=−40.014; z=−26.921
x=155.521; y=−38.480; z=−26.747
x=157.568; y=−36.938; z=−26.572
x=159.608; y=−35.387; z=−26.395
x=161.641; y=−33.827; z=−26.217
x=163.667; y=−32.259; z=−26.037
x=165.686; y=−30.685; z=−25.857
x=167.700; y=−29.103; z=−25.678
x=169.708; y=−27.514; z=−25.498
x=171.710; y=−25.918; z=−25.313
x=173.707; y=−24.317; z=−25.125
x=175.698; y=−22.710; z=−24.935
x=177.685; y=−21.098; z=−24.744
x=179.667; y=−19.482; z=−24.554
x=181.645; y=−17.862; z=−24.366
x=183.620; y=−16.240; z=−24.174
x=185.592; y=−14.614; z=−23.978
x=187.561; y=−12.987; z=−23.779
x=189.528; y=−11.358; z=−23.579
x=191.494; y=−9.727; z=−23.378
x=193.458; y=−8.094; z=−23.179
x=195.421; y=−6.457; z=−22.979
x=197.381; y=−4.817; z=−22.739
x=199.333; y=−3.173; z=−22.533
x=201.286; y=−1.532; z=−22.552.

The line 8 is defined by points 10 having the following coordinates:

x=102.582; y=−69.661; z=−30.610
x=104.393; y=−67.609; z=−30.544
x=106.475; y=−66.003; z=−30.405
x=108.594; y=−64.650; z=−30.312
x=110.739; y=−63.275; z=−30.229
x=112.904; y=−61.945; z=−30.098
x=115.091; y=−60.656; z=−29.960
x=117.285; y=−59.378; z=−29.817
x=119.470; y=−58.086; z=−29.670
x=121.646; y=−56.776; z=−29.519
x=123.810; y=−55.449; z=−29.367
x=125.965; y=−54.104; z=−29.212
x=128.110; y=−52.742; z=−29.056
x=130.245; y=−51.364; z=−28.899
x=132.369; y=−49.971; z=−28.744
x=134.484; y=−48.562; z=−28.587
x=136.588; y=−47.138; z=−28.427
x=138.684; y=−45.699; z=−28.264
x=140.770; y=−44.247; z=−28.097
x=142.848; y=−42.781; z=−27.930
x=144.919; y=−41.303; z=−27.760
x=146.981; y=−39.834; z=−27.591
x=149.039; y=−38.313; z=−27.422
x=151.082; y=−36.802; z=−27.253
x=153.121; y=−35.280; z=−27.079
x=155.154; y=−33.749; z=−26.901
x=157.180; y=−32.208; z=−26.722
x=159.199; y=−30.658; z=−26.542
x=161.213; y=−29.101; z=−26.359
x=163.221; y=−27.535; z=−26.175
x=165.223; y=−25.962; z=−25.990
x=167.221; y=−24.381; z=−25.806
x=169.213; y=−22.794; z=−25.622
x=171.200; y=−21.200; z=−25.436
x=173.182; y=−19.601; z=−24.245
x=175.161; y=−17.995; z=−25.051
x=177.135; y=−16.385; z=−24.856
x=179.108; y=−14.770; z=−24.660
x=181.078; y=−13.151; z=−24.466
x=183.046; y=−11.529; z=−24.272 x=185.012; y=−9.905; z=−24.074 x=186.976; y=−8.278; z=−23.871 x=188.938; y=−6.650; z=−23.666 x=190.899; y=−5.020; z=−23.461 x=192.857; y=−3.387; z=−23.256 x=194.810; y=−1.752; z=−23.056 x=196.754; y=−0.115; z=−22.835 x=198.714; y=1.532; z=−22.581.

3. Cylindrical blade according to claim 1, in which the intersection of the surfaces (3) and (5) with the section (9) defines two curved lines, namely a third edge line (6') on the pressure side and a fourth edge line (8') on the suction side, defined by the same (x) and (y) coordinates as the corresponding lines (6) and (8) and a zero (z) coordinate.

4. Rotor of the purely radial type of a centrifugal compressor with a medium-high flow coefficient, characterized in that it incorporates a plurality of blades (1) according to claim 1.

5. Rotor according to claim 4, characterized in that it has an outer radius of 200 mm and in that it incorporates 19 blades (1).

* * * * *